US008256476B2

(12) United States Patent
Cholewczynski et al.

(10) Patent No.: US 8,256,476 B2
(45) **Date of Patent: *Sep. 4, 2012**

(54) SWING ARM ASSEMBLY WITH REPLACEABLE INSERT FOR USE WITH A DEBARKER APPARATUS

(75) Inventors: Marek Cholewczynski, Victoria (CA); Jorgen Lefsrud, Victoria (CA)

(73) Assignee: Nicholson Manufacturing Ltd., Sidney (CA)

( * ) Notice: Subject to any disclaimer, the term of this patent is extended or adjusted under 35 U.S.C. 154(b) by 358 days.

This patent is subject to a terminal disclaimer.

(21) Appl. No.: 12/445,280

(22) PCT Filed: Oct. 16, 2007

(86) PCT No.: PCT/US2007/081564

§ 371 (c)(1),
(2), (4) Date: Mar. 4, 2010

(87) PCT Pub. No.: WO2008/105963

PCT Pub. Date: Sep. 4, 2008

(65) Prior Publication Data

US 2010/0154932 A1 Jun. 24, 2010

Related U.S. Application Data

(63) Continuation of application No. 11/582,125, filed on Oct. 16, 2006, now Pat. No. 7,350,548.

(51) Int. Cl.
*B27L 1/00* (2006.01)

(52) U.S. Cl. ..... 144/208.4; 144/208.8; 144/208.91

(58) Field of Classification Search ..... 144/208.1, 144/208.4, 208.8, 208.9, 208.91
See application file for complete search history.

(56) References Cited

U.S. PATENT DOCUMENTS

| | | | | |
|---|---|---|---|---|
| 2,788,034 | A | 4/1957 | Brundell et al. | |
| 3,190,327 | A | 6/1965 | Robbins | |
| 3,221,785 | A | 12/1965 | Valo | |
| 3,653,417 | A | 4/1972 | Cervenak | |
| 3,704,733 | A | 12/1972 | McColl | |
| 3,709,272 | A | 1/1973 | Bowers | |
| 3,718,167 | A | 2/1973 | Cervenak | |
| 3,991,800 | A | 11/1976 | Palmquist | |
| 4,280,541 | A | 7/1981 | Reimler et al. | |
| 4,566,371 | A | 1/1986 | Jorgensen et al. | |
| 4,653,559 | A | 3/1987 | Ackerman | |
| 4,657,056 | A | 4/1987 | Hutson | |
| 4,844,201 | A | 7/1989 | Ackerman | |
| 4,865,095 | A | 9/1989 | Magnusson | |
| 5,188,158 | A | 2/1993 | Gstettner et al. | |
| 5,201,353 | A | 4/1993 | Weill | |
| 5,460,212 | A * | 10/1995 | Darden | 144/208.8 |

(Continued)

FOREIGN PATENT DOCUMENTS

| | | |
|---|---|---|
| DE | 2212158 | 9/1972 |

(Continued)

*Primary Examiner* — Bena Miller
(74) *Attorney, Agent, or Firm* — Seed IP Law Group PLLC

(57) ABSTRACT

Apparatuses, systems, and methods for debarking logs are shown and described. The disclosed embodiments can be used for quickly and conveniently replacing contact surfaces, such as leading edges, of-swing arm assemblies (110). Some disclosed embodiments include a swing arm assembly having a replaceable insert (121) that defines a leading edge for engaging logs (130) moving along a processing line. The insert can be made of a wear resistant material for a prolonged life. A worn insert (121) can be replaced with another insert to ensure proper functioning of the debarker.

17 Claims, 9 Drawing Sheets

U.S. PATENT DOCUMENTS

| | | | | |
|---|---|---|---|---|
| 5,472,027 | A | 12/1995 | Ackerman | |
| 6,675,846 | B1 | 1/2004 | Hoffman | |
| 6,834,692 | B2 | 12/2004 | Lindsay et al. | |
| 7,350,548 | B1 * | 4/2008 | Cholewczynski et al. | 144/208.4 |
| 7,461,675 | B2 * | 12/2008 | Eriksson | 144/208.1 |

FOREIGN PATENT DOCUMENTS

| | | | |
|---|---|---|---|
| DE | 3414313 | A1 | 10/1985 |
| FR | 1376318 | | 9/1964 |
| SE | 167467 | | 6/1959 |

* cited by examiner

SWING ARM ASSEMBLY WITH REPLACEABLE INSERT FOR USE WITH A DEBARKER APPARATUS

BACKGROUND

1. Technical Field

The present disclosure in some embodiments generally relates to debarker apparatuses, and more specifically to debarker apparatuses having swing arm assemblies with replaceable inserts.

2. Description of the Related Art

Rotary log debarkers, commonly referred to as ring debarkers, are used to remove bark from logs to facilitate processing of the logs into lumber and other wood products. Rotary log debarkers often have an array of swing arms pivotally mounted to a rotatable outer ring. Each of the swing arms has a tip for scraping bark from the logs.

As a log moves along a processing line of a traditional debarker, the advancing log contacts and pushes against the leading edges of the swing arms carried by the rotating outer ring. The log then drives the swing arms outwardly until the tips of the swing arms engage the periphery of the log. In this manner, swing arms can be self-opened. Once opened, the swing arms are urged inwardly such that the tips scrape bark off the log. The tips often remove the bark in a somewhat spiral pattern.

Unfortunately, the leading edges of the swing arms may be damaged due to the applied loads (e.g., the axial loads produced when each of the logs strikes against the swing arms) and frictional interaction with the logs. After repeated use, the leading edges may become dull, blunt, roughened, or otherwise damaged such that undesirable large frictional forces are present when the leading edges contact the logs. These frictional forces can prevent proper self-opening of the swing arms and may also damage the ends of the logs. For example, roughened leading edges can scrape wood from the ends of the logs, thus reducing the amount of usable wood resulting in decreased lumber production.

To maintain proper self-opening and limit this unwanted damage to the logs, the leading edges of the swing arms are often repaired by building-up new leading edges. For example, material can be welded over a damaged leading edge to form a new leading edge. Unfortunately, because welding often creates irregular surfaces, it may be difficult to form a leading edge sufficiently smooth for consistent self-opening of the swing arms. Moreover, a lengthy welding process can result in significant machine downtime, thereby reducing lumber production. Other problems, such as induced residual stresses, reduced toughness (e.g., fracture toughness), and the like, are also associated with welding processes.

Because leading edges are difficult to repair, worn swing arms may be frequently replaced with new swing arms.

BRIEF SUMMARY OF THE INVENTION

Some embodiments disclosed herein include the realization that swing arm assemblies of a debarker apparatus can have one or more replaceable inserts. The inserts can be positioned to engage the logs and, thus, may be subjected to cyclic loading. In some embodiments, the inserts are comprised mostly of a high wear resistant material, such as hardened materials, for a prolonged life. If the inserts are not performing properly, the inserts can be quickly replaced. After the inserts have been worn a predetermined amount, for example, the inserts can be quickly replaced resulting in less machine downtime as compared to the downtime required to replace swing arm assemblies or form new leading edges. The inserts can provide suitable high wear surfaces, edges, or other contact regions for engaging logs.

The insert and a main body of the swing arm assembly can each have one or more fastener areas. Complementary fastener areas can facilitate proper positioning of the insert. In some embodiments, the insert comprises a fastener area having a plurality of discrete fastening features positioned to mate with a plurality of discrete fastening features of a fastener area of the main body. The fastening features can be holes, fasteners, or other suitable fastening features.

A working end of the swing arm is configured to remove bark from the log as the carriage rotates. A main body of the swing arm extends between the mounting end and working end. An insert is removably coupled to the main body and is configured to cause the swing arm assembly to move from the inner position towards the outer position when the insert engages an end face of the log moving along the processing line towards the insert while the carriage rotates In some embodiments, an apparatus for removing bark from a log is provided. The apparatus includes a rotatable carriage having an opening sized to receive a log moving along a processing line passing through the opening. The swing arm assembly also includes a mounting end rotatably coupled to the carriage such that the swing arm assembly is movable between an inner position and an outer position. A working end of the swing arm is configured to remove bark from the log as the carriage rotates. A main body of the swing arm extends between the mounting end and working end. An insert is removably coupled to the main body and is configured to cause the swing arm assembly to move from the inner position towards the outer position when the insert engages an end face of the log moving along the processing line towards the insert while the carriage rotates.

In some embodiments, the insert extends away from a sidewall of receiving portion (e.g., a recess) outwardly past the main body to form a leading edge for contacting logs.

In some embodiments, the working end has a removable debarking tool. In some embodiments, the main body includes an insert receiving recess positioned between the debarking tool and the mounting end. The insert can be positioned in the recess. The insert abuts a sidewall of the recess and protrudes outwardly from the recess and main body to define a leading edge spaced from the main body. The leading edge causes the swing arm to move from the inner position when the leading edge engages the log.

In some embodiments, the main body is physically connected to the mounting end and the working end. The main body can be a unitary body that extends continuously between the mounting end and the working end. The insert can also be removed without damaging the main body.

In yet other embodiments, a swing arm assembly for removing material from a log comprises a mounting end, debarker tool, main body, and an insert. The mounting end is configured to rotatably couple the swing arm assembly to a debarker. The debarker tool end is configured for receiving a tool adapted for removing bark from the log. The main body extends between the mounting end and debarker tool end. The main body also has a receiving portion. The insert is adapted to be removably coupled to the receiving portion. The insert extends longitudinally along at least a portion of the main body from a location proximate the debarker tool.

In some other embodiments, an insert for coupling to a swing arm assembly with a receiving section is provided. The insert includes a main body, an edge portion, and at least one fastener area. The main body is dimensioned to be closely received in the receiving section of the swing arm assembly.

The edge portion is connected to the main body. The edge portion extends along a generally curved path and is configured to physically engage a log to facilitate movement of the swing arm assembly from a first, closed position to a second, open position when the insert is installed on the swing arm assembly and the edge portion contacts an end face of the log during operation. The fastener area is positioned along the main body and is configured to mate with a fastener for removably coupling the insert to the swing arm assembly.

In some embodiments, a method of installing an insert on a debarker swing arm assembly having a receiving portion is provided. The method includes positioning a replaceable insert in the receiving portion of the debarker swing arm assembly. The receiving portion is positioned between a debarker tool and a mounting end of the debarker swing arm assembly. The debarker tool is configured to remove bark. The mounting end is rotatably coupleable to the debarker apparatus. The insert is removably coupleable to the receiving portion with one or more fasteners.

In some embodiments, an apparatus for removing bark from a log includes a rotatable carriage for receiving a log. A swing arm assembly of the apparatus includes a mounting end rotatably coupled to the carriage such that the swing arm assembly is movable between an inner position and an outer position. A camming member is coupled to the swing arm assembly. In some embodiments, the camming member can be an insert configured to slide along a log. In some embodiments, the camming member is an elongate protective member for mounting directly to a main body of the swing arm assembly.

DETAILED DESCRIPTION OF THE INVENTION

The present detailed description is generally directed towards a debarker apparatus with a plurality of swing arm assemblies, each having at least one replaceable insert. Some embodiments of the swing arm assemblies have a replaceable insert that defines a contact surface, such as a leading edge, for engaging logs. Many specific details of certain exemplary embodiments are set forth in the following description and in FIGS. 1 to 9 to provide a thorough understanding of such embodiments. One skilled in the art, however, will understand that the disclosed embodiments may be practiced without one or more of the details described in the following description.

Additionally, the swing arm assemblies are disclosed in the context of log debarkers because they have particular utility in this context. However, the swing arm assemblies can be used in other contexts. For example, the swing arm assemblies can be used to slice bark or otherwise process logs, lumber, and the like. Terms, such as "inward," "outward," "proximal," and "distal," are used to describe the illustrated embodiments and are used consistently with the description of non-limiting exemplary applications. The terms "proximal" and "distal" are used in reference to a log when the debarker apparatus processes the log, unless the context clearly indicates otherwise. For example, a proximal feature of the swing arm assembly is closer to the log than a distal feature of the swing arm assembly. It will be appreciated, however, that the illustrated embodiments can be located or oriented in a variety of desired positions.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise. For purposes of this description and for clarity, a debarker apparatus will be described and then a description of its components will follow.

Figure 1:
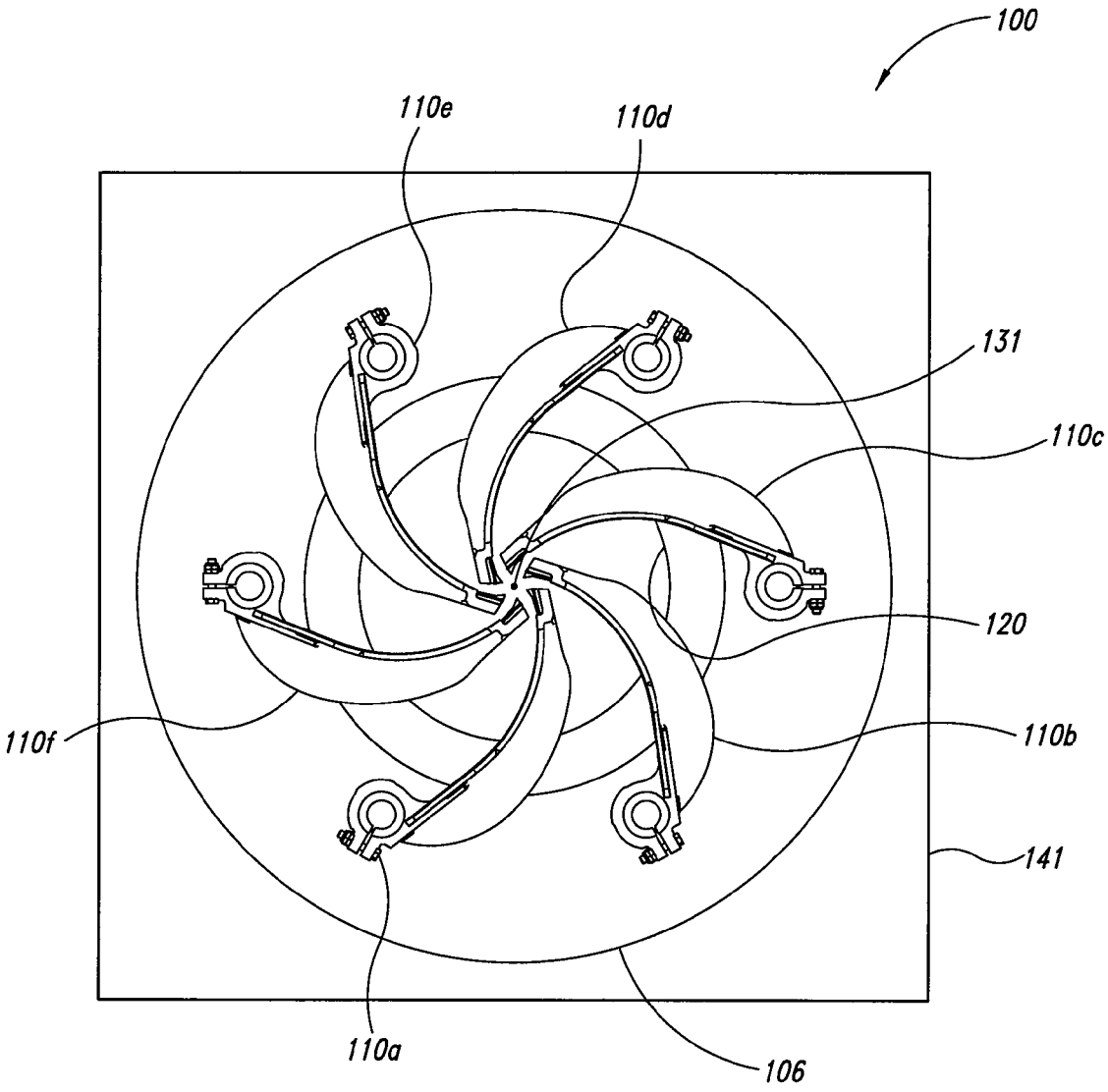
FIG. 1 is a front elevational view of a debarker apparatus having movable swing arm assemblies.
Figure 2A:
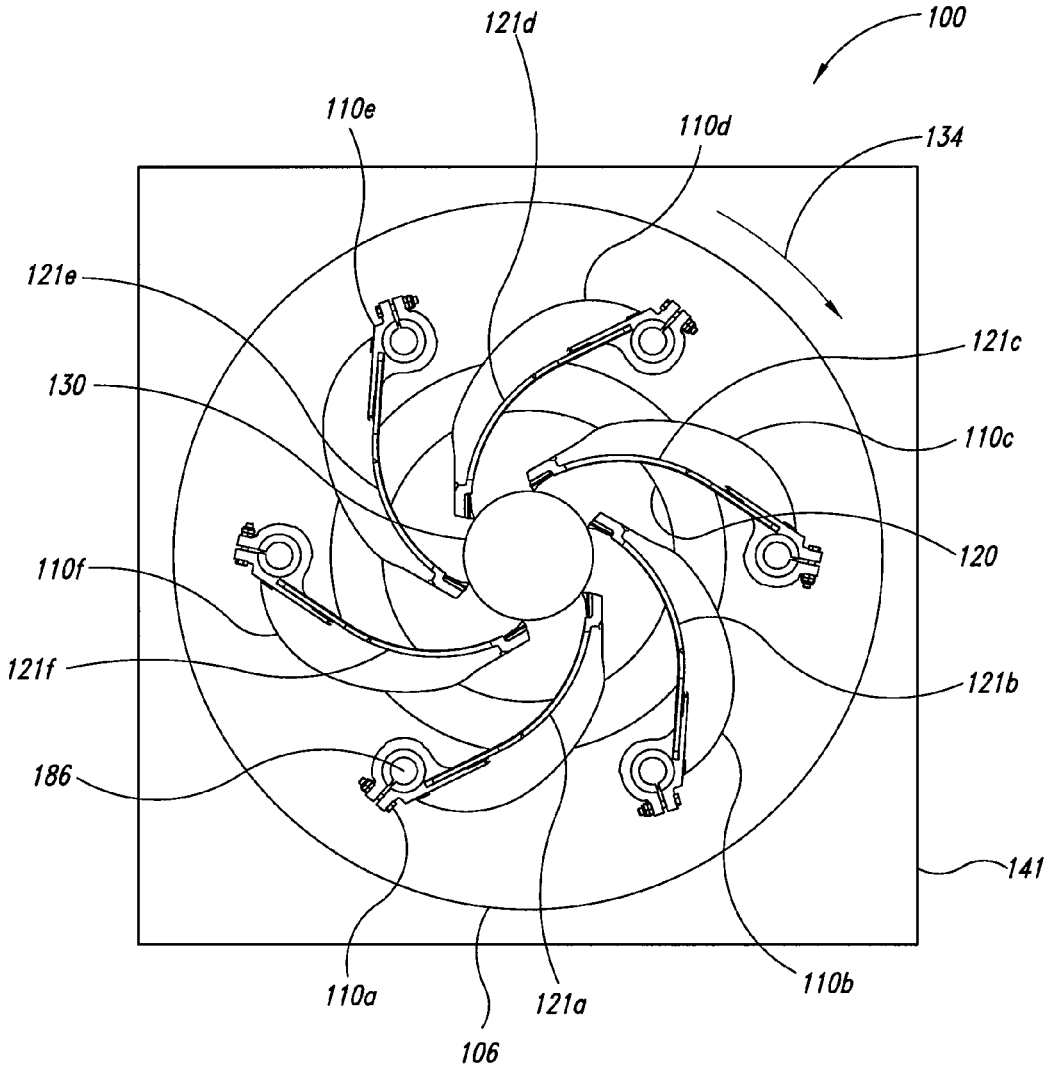
FIG. 2A is a front elevational view of the debarker apparatus of FIG. 1, where the swing arm assemblies surround a log.
Figure 2B:
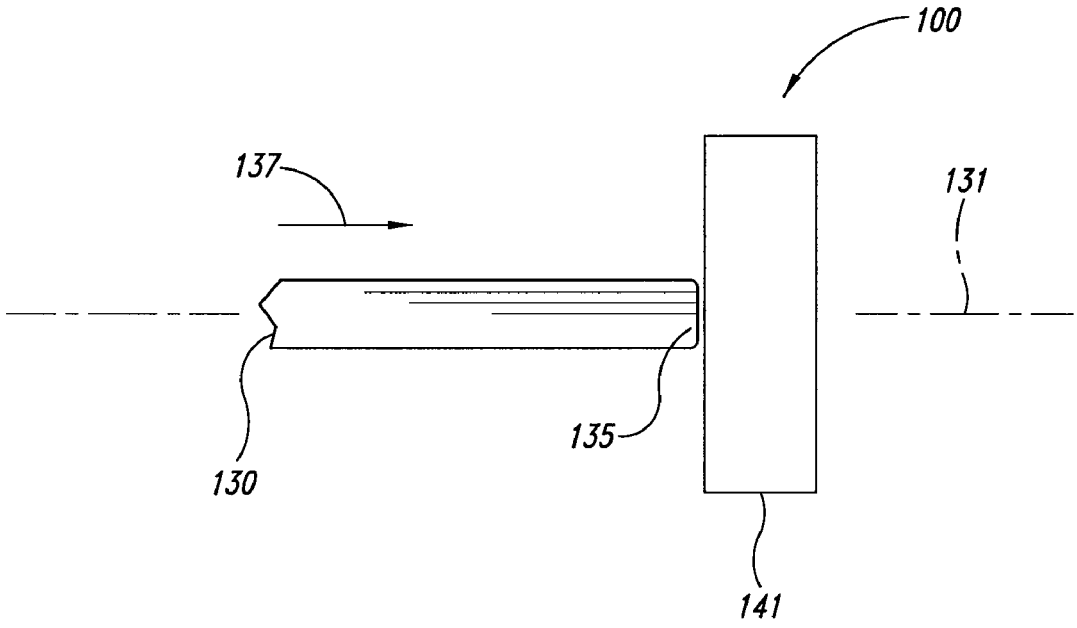
FIG. 2B is a top plan view of the debarker apparatus and log of FIG. 2A, where the log is spaced from the debarker apparatus.

FIGS. 1 to 2B illustrate a debarker apparatus 100 for removing bark from a log. The debarker apparatus 100 includes a rotatable carriage 106 and a plurality of swing arm assemblies 110*a-f* pivotally coupled to the carriage 106. The swing arm assemblies 110*a-f* surround a processing line 131 and are movable between an inner position (FIG. 1) and an outer position (FIG. 2A). The rotatable carriage 106 has an opening 120 shaped and dimensioned to receive a log 130 moving down the processing line 131, which extends through the opening 120. Inserts 121*a-f* are coupled to the swing arm assemblies 110*a-f*, respectively. When each of the swing arm assemblies 110*a-f* is in the inner position, the inserts 121*a-f* can be generally aligned with the opening 120.

Logs are transported lengthwise along the processing line 131 while the carriage 106 rotates. The illustrated carriage 106 is rotated in the clockwise direction (indicated by the arrow 134 in FIG. 2A) as a log 130 is advanced lengthwise through the opening 120, as indicated by the arrow 137 in FIG. 2B. The end 135 of the log 130 comes into contact with replaceable inserts 121*a-f*, which at least partially blocking the opening 120. The inserts 121*a-f* can slide spirally outward along the end 135 of the log 130 until the swing arm assemblies 110*a-f* open and surround and engage the exterior (bark) surface of the log 130, as shown in FIG. 2A.

Because logs repeatedly strike the inserts 121*a-f*, the inserts 121*a-f* may be formed in whole or in part of a wear resistant material to minimize wear. Even so, the inserts 121*a-f* may become dull, deformed, worn, roughened, and/or otherwise damaged, especially after extended use. To enhance performance of the swing arm assemblies 110*a-f*, damaged inserts 121*a-f* can advantageously be replaced with new inserts thereby ensuring proper operation of the swing arm assemblies 110*a-f*. If the leading edges of the inserts

121*a-f* scrape enough wood from the ends of the logs, for example, the swing arm assemblies 110*a-f* may not self-open properly. The inserts 121*a-f* can be replaced as needed to provide proper self-opening of the swing arm assemblies 110*a-f* and also limit or minimize damage to the ends of the logs, thus increasing the amount of usable wood resulting in increased lumber production.

As noted above, the swing arm assemblies 110*a-f* rotate outwardly in a self-opening manner until the working ends of the swing arm assemblies 110*a-f* engage the periphery of the log. The carriage 106 then rotates the swing arm assemblies 110*a-f* about the log 130 such that the working ends of the swing arm assemblies 110*a-f* move along a helical path to process (e.g., scrape, cut, or roughen) the outer surface on the logs. The illustrated swing arm assemblies 110*a-f* are configured to scrape a desired amount of bark from the logs.

Various types of carriages can be used with the swing arm assemblies 110*a-f*. The illustrated carriage 106 is rotatably coupled to a debarker drive system 141 and biases the swing arm assemblies 110*a-f* inwardly against the log 130 with a desired force (e.g., a constant or variable force). One or more biasing systems in the carriage 106 are utilized to bias the swing arm assemblies 110*a-f*. Thus, the debarker apparatus 100 can controllably increase or decrease the amount of material removed from the logs.

FIGS. 3A to 8 illustrate components of the debarker apparatus 100 shown in FIGS. 1-2B. It should be noted that the swing arm assemblies 110*a-f* can be generally similar to each other and, accordingly, the following description of one of the swing arm assemblies applies equally to the others, unless indicated otherwise.

Figure 3A:
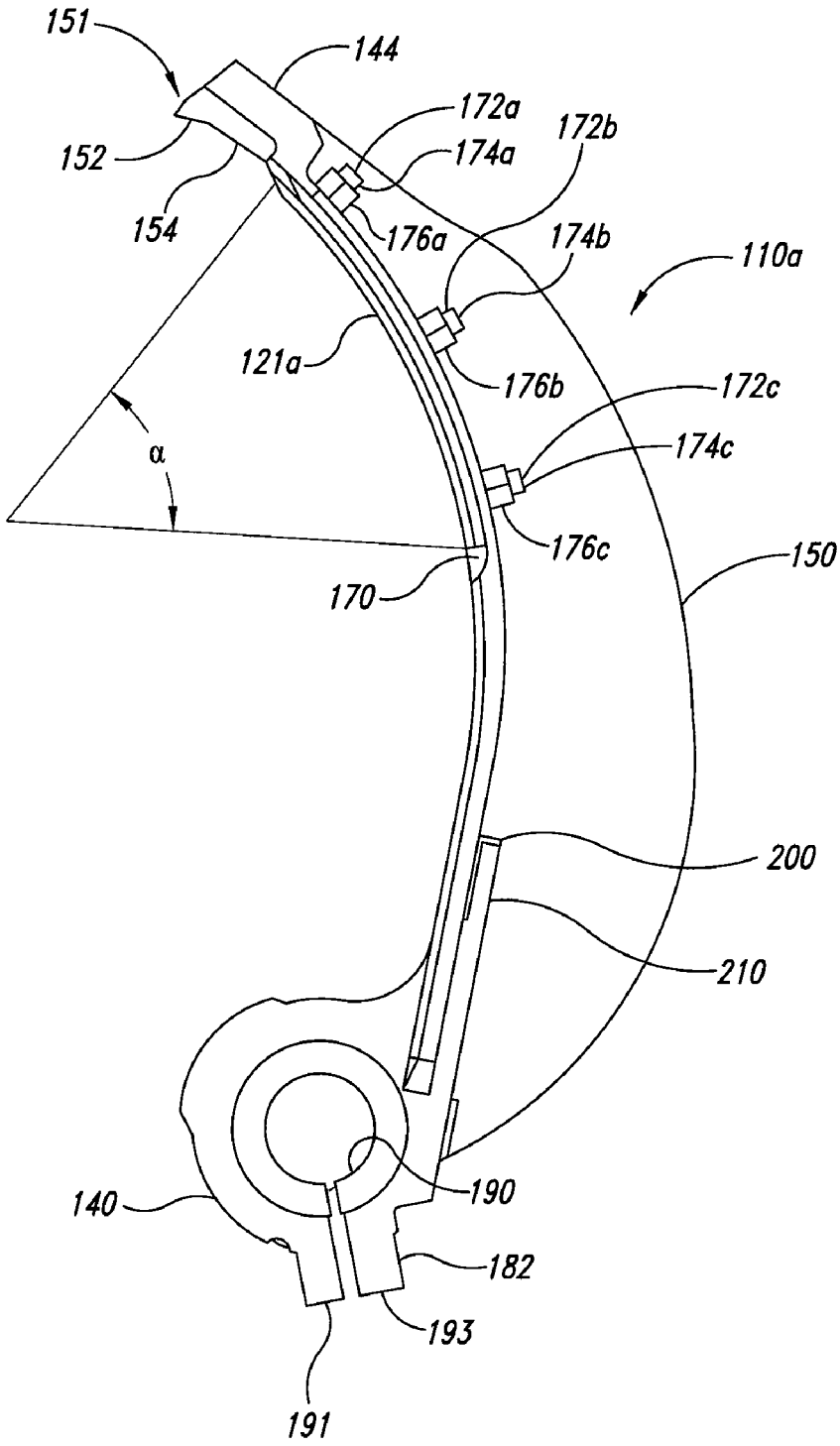
FIG. 3A is a front elevational view of a swing arm assembly with a leading edge insert.

FIG. 3A illustrates the swing arm assembly 110*a* having a mounting end 140, a working end 144, and a main body 150 extending between the mounting end 140 and working end 144. The replaceable insert 121*a* is mounted to the main body 150.

The working end 144 is configured to scrape bark from a log. As used herein, the term "working end" is a broad term and generally refers, without limitation, to a distal end of a swing arm assembly having one or more debarker tools or other elements for bark removal. The working end can have a one-piece or multi-piece construction. For example, the illustrated working end 144 has a removable debarking tool 151, including a scraping knife 152 connected to a body 154. In other embodiments, the working end 144 is integral with the swing arm assembly 110*a*. For example, the working end 144 can be a sharpened knife monolithically formed with the main body 150. The design of the working end 144 can be selected based on line speeds, sizes and types of logs to be processed, and other operating parameters known in the art.

The insert 121*a* is detachably mounted to an insert receiving portion 170 of the main body 150. A plurality of fasteners 172*a-c* fixedly couples the insert 121*a* to the insert receiving portion 170. The term "fastener" is a broad term and generally refers, without limitation, to one or more devices or structures that are capable of coupling an insert to the main body of a swing arm assembly during normal use. A fastener can include, but is not limited to, one or more nut/bolt assemblies, pin/rod assemblies, threaded members, nuts, combinations thereof, and the like. As used herein, the term "bolt" is to be construed broadly and may include, without limitation, an externally threaded fastener that can be inserted through a hole (e.g., circular holes, elliptical holes, and the like) and configured to receive a threaded nut. A bolt, in some embodiments, may have a head (e.g., a hexagonal head, square head, slotted head, etc.) that engages the surface of the insert 121*a* or main body 150 of the swing arm assembly 110*a*. The term "nut" is a broad term and generally refers, without limitation, to internally threaded members that can be threadably coupled to a bolt. For example, the openings in the swing arm assembly 110*a* and/or the insert 121 can be threaded to engage the bolt.

The illustrated fasteners 172*a-c* comprise bolts 174*a-c*, respectively, extending through both the insert 121*a* and a base member 180 of the main body 150. Nuts 176*a-c* are threadably coupled to the bolts 174*a-c*, respectively. The fasteners 172*a-c* pull the insert 121*a* securely against the main body 150. Of course, the fasteners 172*a-c* can be used to tighten or loosen the insert 121*a*.

The fasteners 172*a-c* can also be operated for conveniently and quickly decoupling the insert 121*a* from the main body 150. Unlike welds or other types of built-up leading edges, the inserts can be rapidly replaced without damaging the underlying main body 150. This reduces the offline time and therefore increases production.

With continued reference to FIG. 3A, the mounting end 140 is configured to be pivotally attached to the carriage 106. The illustrated mounting end 140 includes a bracket assembly 182 for coupling to a rotating drive member 186 of the carriage 106, as shown in FIG. 2A. An opening 190 of the bracket assembly 182 can be dimensioned to receive the drive member 186. After assembling the bracket assembly 182 and drive member 186, the bracket ends 191, 193 of the bracket assembly 182 can be drawn together to tightly clamp onto the drive member 186. In this manner, the swing arm assembly 110*a* can be fixedly coupled to the drive member 186.

Other types of mounting arrangements can also be used to couple the swing arm assemblies 110*a-f* to the carriage 106. For example, each of the swing arm assemblies 110*a-f* can have a mounting end with an outwardly extending drive shaft. Each drive shaft can be received within a complementary chuck of the carriage 106. To articulate the swing arm assemblies 110*a-f*, the chucks can apply moments to the swing arm assemblies 110*a-f* as desired.

Figure 4:
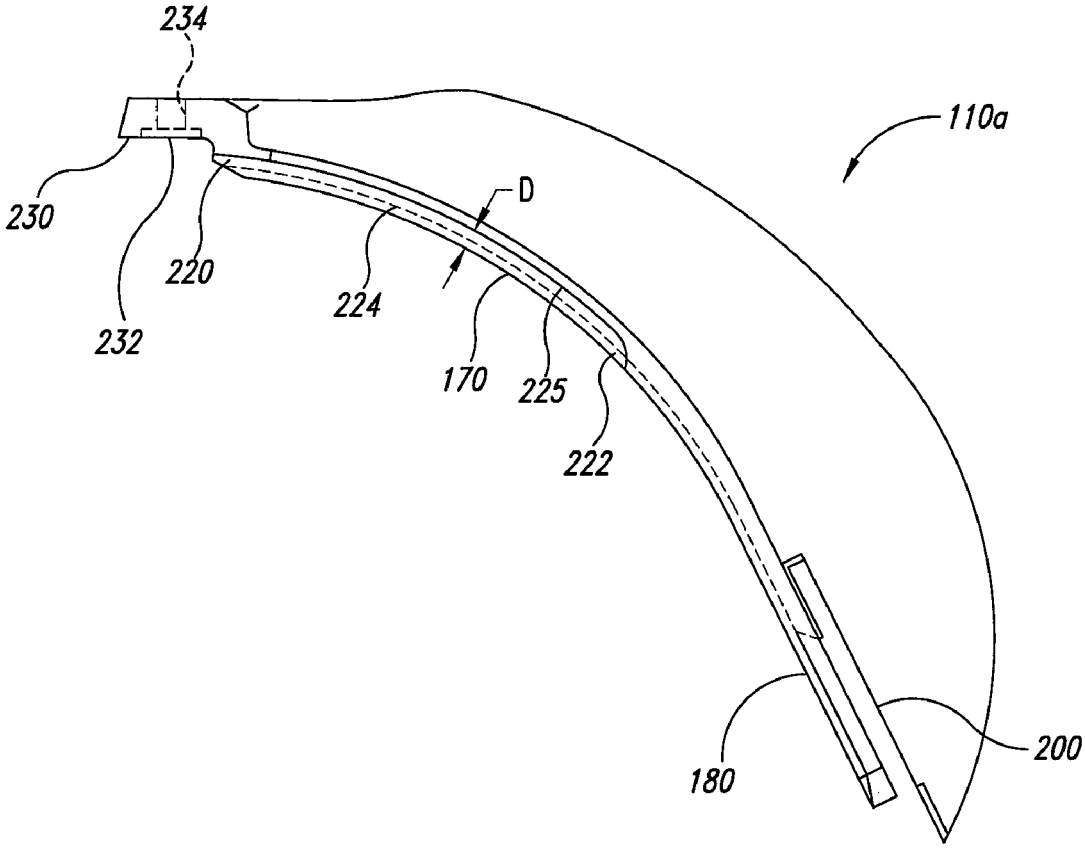
FIG. 4 is a front elevational view of a main body of the swing arm assembly of FIG. 3A.
Figure 5:
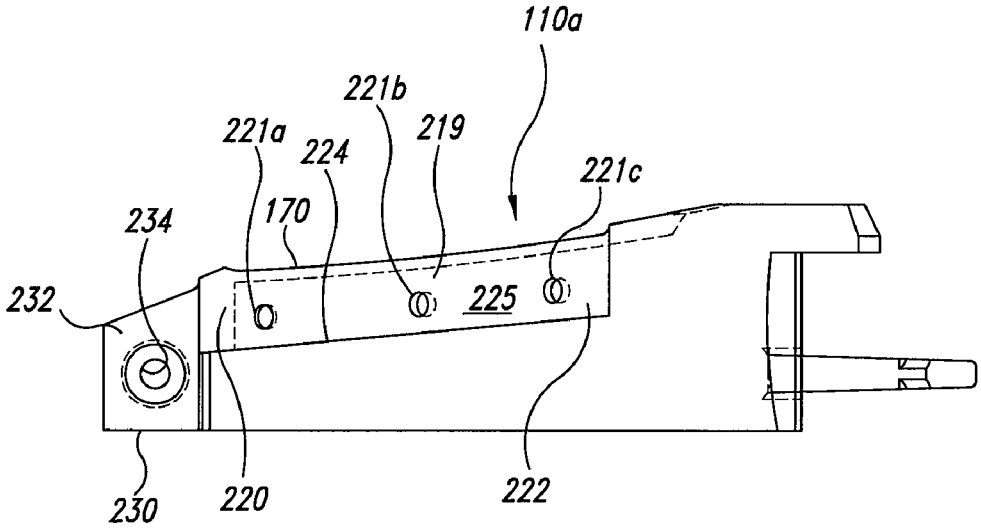
FIG. 5 is a bottom plan view of the main body of the swing arm assembly of FIG. 3A.

As shown in FIGS. 3A, 4, and 5, the main body 150 includes a mounting portion 200 for permanently or temporarily coupling to the mounting end 140. An elongate plate 210 of the mounting end 140 can be slid into and positioned in the portion 200. Once positioned, the plate 210 can be fixedly coupled to the main body 150 by welds, fasteners, or other suitable coupling means. Other types of mounting arrangements can also be used to couple the mounting end 140 to the main body 150.

With reference again to FIGS. 3A and 3B, the receiving portion 170 of the main body 150 can closely receive the insert 121*a*. The illustrated receiving portion 170 is an elongate recess positioned along the front side (i.e., the leading edge side) of the base member 180 of the main body 150. As shown in FIGS. 4 and 5, the receiving portion 170 includes a distal end 220, proximal end 222, and sidewall 224 extending therebetween. A receiving surface 225 extends between the sidewall 224, distal portion 220, and the proximal portion 222. The receiving portion 170 also includes a fastener area 219 that comprises a plurality of throughholes 221*a-c*.

The sidewall 224 can act as a stop to inhibit, limit, or substantially prevent relative movement between the insert 121*a* and main body 150. When the log strikes the insert 121*a*, for example, the sidewall 224 can provide a reactive force that inhibits, limits, or substantially prevents movement of the insert 121*a*. Thus, the receiving portion 170 maintains the proper positioning of the insert 121*a*, even after continued use over a long period of time. The sidewall 224 can be generally perpendicular to the direction of the axially loads applied by the logs to reduce sliding between the insert 121*a* and sidewall 224. However, the sidewall 224 can also be at other orientations.

Additionally, the sidewall 224 can limit loads applied to the fasteners 172*a-c*. For example, the sidewall 224 can provide sufficient reactive forces to limit shear loads applied to the fasteners 172*a-c* below desired levels. The receiving portion 170 therefore inhibits, limits, or substantially prevents damage (e.g., deformation, shearing, etc.) to the fasteners 172*a-c*.

The depth D of the receiving portion 170 can be selected such a portion of the insert 121*a* is nested in the receiving portion 170. In the illustrated embodiment of FIGS. 3A and 3B, a substantial portion of the insert 121*a* is positioned within the receiving portion 170.

The illustrated insert receiving portion 170 is a strip-like recess as viewed from below (see FIG. 5) and is positioned at some point between a debarker tool anchoring portion 230 and the mounting end 140. In the illustrated embodiment, the receiving portion 170 is positioned proximate the anchor portion 230 and extends towards the mounting end 140. In some embodiments, the receiving portion 170 is formed, at least in part, by the anchor portion 230 and/or the debarking tool 151. In other embodiments, the receiving portion 170 is spaced from the anchor portion 230. When the debarking tool 151 contacts the log, the insert 121*a* is preferably spaced from the log.

The configuration of the receiving portion 170 can be selected based on the configuration of the insert to be positioned therein. That is, the shape and dimensions (e.g., the length, width, etc.) of the receiving portion 170 can generally match the shape and dimensions of the insert 121*a*. The exposed surfaces of the insert 121*a* are positioned to engage logs. Because the insert 121*a* and receiving portion 170 have complementary configurations, the insert 121*a* can be nested in the receiving portion 170 such that the insert 121*a* is fixedly coupled to the main body 150, even when logs strike the insert 121*a* with significant forces.

In other embodiments, the insert 121*a* may not be positioned within an insert receiving portion. If the insert 121*a* is used as a retrofit, for example, the insert 121*a* can be mounted to a swing arm without an insert receiving portion. In such embodiments, stops or other types of positioners can be added to the swing arm to limit movement of the insert.

With continued reference to FIGS. 4 and 5, the anchor portion 230 of the main body 150 is configured to receive and hold the debarking tool 151, as shown in FIG. 3A. The illustrated anchor portion 230 includes a recess 232 and a throughhole 234 (illustrated as a countersunk hole) extending from the recess 232. A fastener can extend from the debarker tool 151 through the hole 234 to secure the tool 151 to the main body 150. Various types of other mounting arrangements can be used to couple the debarker tool 151 to the main body 150.

Figure 6:
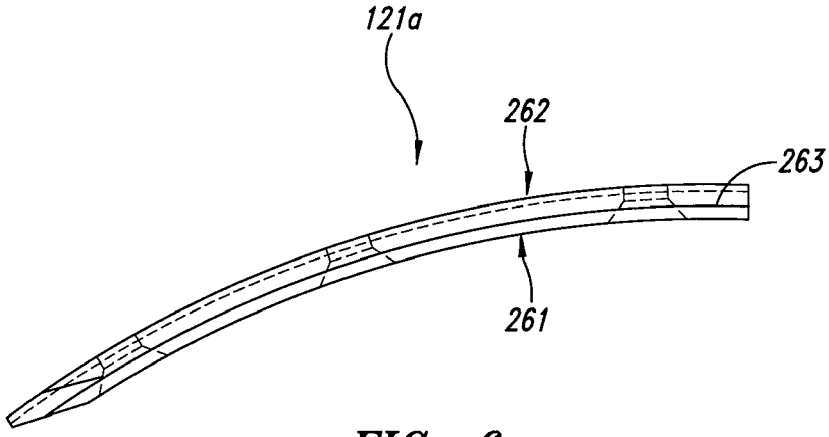
FIG. 6 is a front elevational view of a leading edge insert for use with a swing arm assembly.
Figure 7:
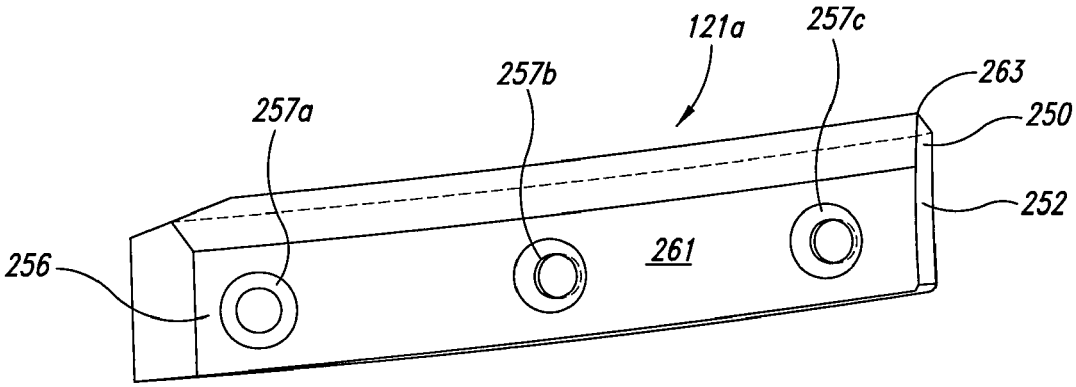
FIG. 7 is a bottom elevational view of the insert of FIG. 6.
Figure 8:
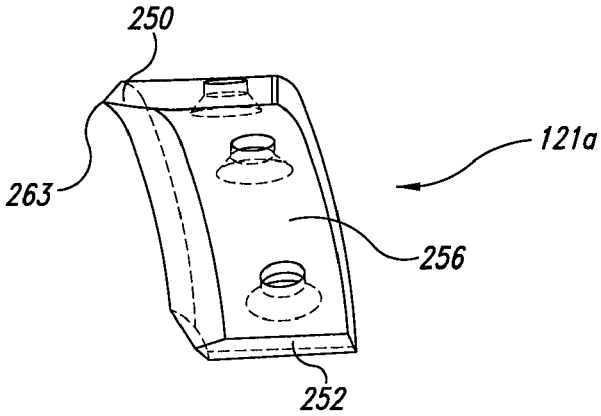
FIG. 8 is a side elevational view of the insert of FIG. 6.

FIGS. 6 to 8 illustrate the insert 121*a* having a generally curved shaped as viewed from the front. The illustrated insert 121*a* has a leading edge portion 250, main body 252, and fastener area 256 positioned along the main body 252. The fastener area 256 is configured to mate with the fastener area 219 of the receiving portion 170. The illustrated fastener area 256 includes a plurality of evenly spaced throughholes 257*a-c* positioned longitudinally along the main body 252. To install the insert 121*a*, the throughholes 257*a-c* can be aligned with the throughholes 221*a-c*, respectively. The fasteners 172*a-c* can then be installed in the correspondingly aligned holes.

The fastener areas 256, 219 can have any suitable number of throughholes. The illustrated fastener area 256 includes three countersunk throughholes 257*a-c* for receiving tapered bolt heads. However, the throughholes 257*a-c* can have other configurations.

With continued reference to FIGS. 7 and 8, the lead edge portion 250 defines an edge 263 for initially engaging the log 130. The illustrated edge 263 extends along a generally curved path extending along a substantial portion of the length of the insert 121*a*. In some embodiments, the edge 263 extends along a generally arcuate path, generally helical path, partially elliptical path, or any other suitable path for facilitating self-opening of the swing arm assembly. The shape of the edge 263, for example, can be selected such that the insert 121*a* slides easily along the end of the log 130 in order to move the swing arm assembly from the inner position to the outer position. In some embodiments, the edge 263 is a somewhat sharp edge for cutting into the log. The interaction between the edge 263 and the log 130 can cause self-opening of the swing arm assembly 110*a*.

The insert 121*a* can subtend various angles. The illustrated insert 121*a* of FIG. 3A subtends an angle $\alpha$ of about 40 degrees. The insert 121*a* in some embodiments subtends an angle of about 35 degrees to about 45 degrees. In some embodiments, the insert 121*a* subtends an angle less than about 90 degrees, 60 degrees, or 30 degrees. To form the insert 121*a*, a tubular body can be cut on a bias to form slanted rings. The rings can be cut into nine segments to form the insert 121*a*. The insert 121*a* can be formed from a helical strip, annular ring, elliptical rings, and the like and can also have a generally uniform or varying thickness. In the illustrated embodiment of FIG. 6, for example, a mounting surface 261 and an opposing outer face 262 of the insert 121*a* define a generally uniform thickness. The insert 121*a* can also be cast or formed through other suitable methods.

To install the insert 121*a*, the fastener area 256 of the insert 121*a* is aligned with the fastener area 219 of the main body 150 of the swing arm assembly 110*a*. In the illustrated embodiment, the throughholes 257*a-c* of the fastener area 256 are registered with corresponding throughholes 221*a-c* of the fastener area 219. The fasteners 172*a-c* are then assembled.

Figure 3B:
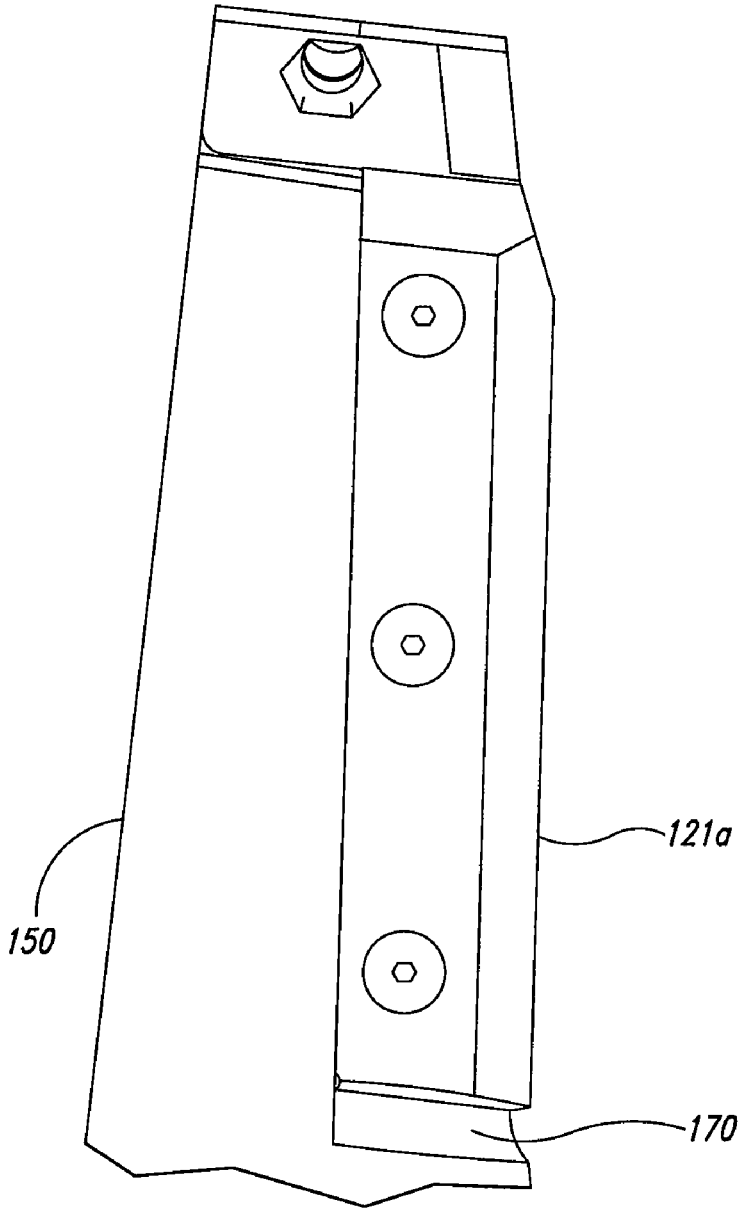
FIG. 3B is a side elevational view of a working end of the swing arm assembly of FIG. 3A, where the debarker tool has been removed.

When assembled, the leading edge portion 250 can protrude outwardly from the main body 150, as shown in FIG. 3B. The width of the insert 121*a* can be selected based on the desired distance that the leading edge portion 250 protrudes from the main body 150. The protruding edge 263 can contact and prevent the log from contacting the main body 150, thus limiting or preventing damage or wear to the main body 150, even if the edge 263 presses into the log.

The illustrated insert 121*a* has a unitary, one-piece construction. In other embodiments, the insert 121*a* can have a multi-piece construction. For example, a plurality of inserts can form the insert 121*a*. Advantageously, a damaged insert can be replaced without replacing all of the inserts.

The insert 121*a* can comprise a hardened material to prevent excessive wear to contact areas and increase its useful life. As used herein, the term "hardened material" is a broad term and includes, but is not limited to, materials that have a high wear resistance, such as tungsten/cobalt carbide, hardened steel alloys, carbide alloys, combinations thereof, or other high wear materials.

In some embodiments, the insert 121*a* and main body 150 are formed of similar materials, or the same material. In other embodiments, the insert 121*a* and main body 150 are formed of different materials. For example, the insert 121*a* can comprise mostly a first material. The main body 150 can comprise mostly a second material which is different than the first material. In some embodiments, the main body 150 can be formed of steel or other suitable material for withstanding large loads. The insert 121*a* can be formed of a harder material which may be especially well suited for sliding along logs with a minimal amount of wear. In one exemplary non-limiting embodiment, the main body 150 can be cast or formed of steel, and the insert 121*a* can be cast or formed of a harder material, such as a hardened steel alloy, tool steel, carbide alloy, and the like. Thus, materials can be selected and positioned along the swing arm assembly based on physical properties, material costs, weight, corrosion resistance, and the like.

To install the insert 121*a*, the insert 121*a* can be positioned in the receiving portion 170 of the debarker swing arm, as noted above. The fastener area 256 of the insert 121*a* can be mated with the complementary fastener area 219 of the receiving portion 170. The insert 121*a* can be at least proximate the sidewall 224. The mounting surface 261 of the insert 121*a* can rest against the receiving surface 225 of the receiving portion 170. The fasteners 172*a-c* can be used to removably couple the insert 121*a* to the receiving portion 170. The fasteners 172*a-c* can extend through the mounting surface 261 and receiving surface 225 and can be operated to adjust the contact forces between the mounting surface 261 and the receiving surface 225. The openings can be countersunk. The assembled swing arm assembly 110*a* can then be used to debark logs.

After the insert 121*a* has been worn a predetermined amount, the insert 121*a* can be replaced. The fasteners 172*a-c* can be disengaged from the swing arm assembly 110*a* to permit removal of the insert 121*a*. After removing the insert 121*a* from the receiving portion 170, a second insert can be placed in the receiving portion 170. The second insert may be similar to or different than the first insert 121*a*. The fasteners 172*a-c* can couple the new insert to the receiving portion 170 in a similar manner. This replacement process can be repeated any number of times as desired or needed.

The swing arm assemblies 110*a-f* of FIGS. 1 and 2A can be installed in a debarker apparatus by the original equipment manufacture ("OEM"). A skilled artisan can design the swing arm assemblies 110*a-f* for mounting onto various known debarkers, such as, for example, the debarkers disclosed in U.S. Pat. Nos. 3,190,327; 4,566,371; and 4,844,201, which are hereby incorporated by reference in their entireties. The swing arm assemblies 110*a-f* and/or inserts can also be aftermarket retrofits. For example, the inserts can be mounted on traditional swing arms, where the swing arms have been modified by forming bolt holes or other suitable features in the swing arms. The inserts 121*a* can be installed using these features. The swing arm assemblies 110*a-f* or its components can be used with the carriages (e.g., rotatable rings), actuating systems, techniques and methods described in U.S. Pat. Nos. 3,190,327; 4,566,371; and 4,844,201. It is contemplated that the swing arm assemblies can be mounted on the down-line side or up-line side of the carriage.

Figure 9:
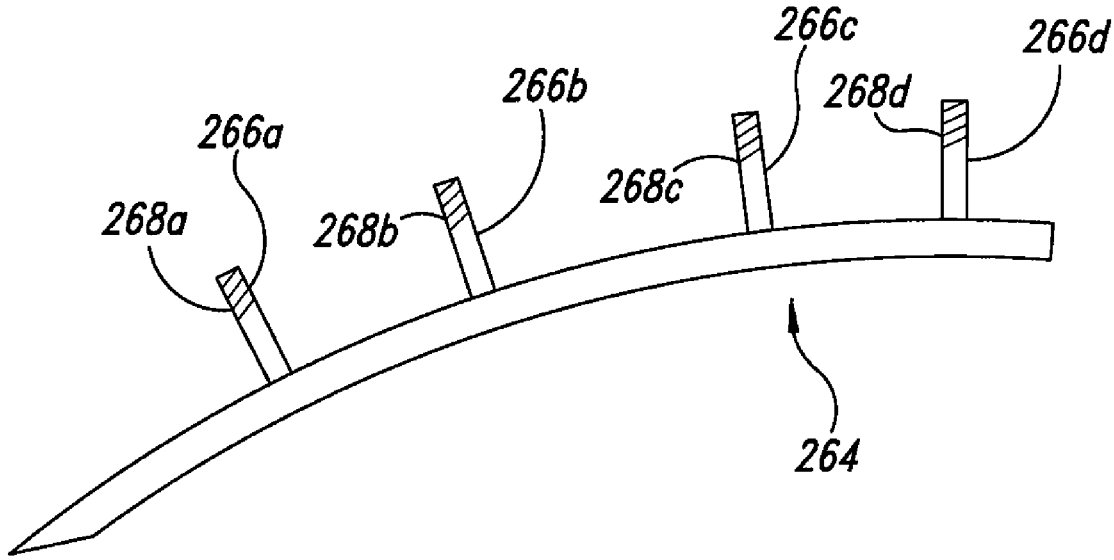
FIG. 9 is a side elevational view of a leading edge insert in accordance with another embodiment.

FIG. 9 illustrates an insert 264 that is generally similar to the insert 121*a*, except as detailed below. The insert 264 has a plurality of externally threaded members 266*a-d* that can be received in corresponding holes in a main body of a swing arm assembly. For example, the members 266*a-d* can be inserted through an array of throughholes in main body. Internally threaded nuts can then be coupled to the externally threads 268*a-d*.

The fastener area of the inserts can include one or more nipples, threaded members, or other types of fasteners that can be received by complementary features on the main body. The type and configuration of the fastener area can be selected based on operating parameters, such as line speeds, thickness of bark to be removed, and the like.

Figure 10:
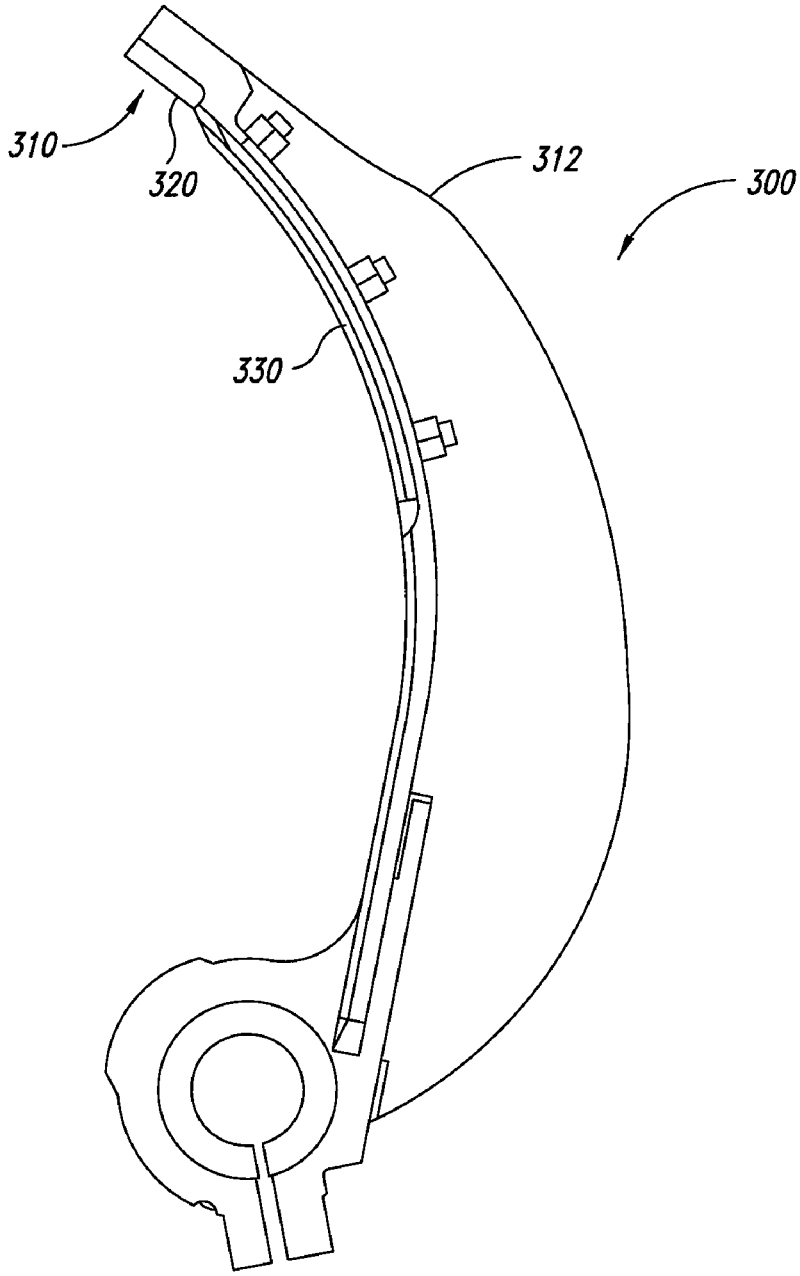
FIG. 10 is a front elevational view of a swing arm assembly with a leading edge insert and a slicing assembly, in accordance with another embodiment.

FIG. 10 illustrates a swing arm assembly 300 that has slicing head 310 coupled to a main body 312. The slicing head 310 has a cutting edge 320 that can be linear, concave, convex, or have any other suitable configuration for engaging the periphery of the log. An insert 330 is positioned near the slicing head 310. In operation, cutting edge 320 slits the bark in a helical path having a lead angle determined by the line speed of the advancing log, the rotational speed of the carriage, and dimensions (e.g., the diameter) of the log. As the cutting edge 320 moves along the log, the insert 330 can be spaced between the log and the carriage carrying the swing arm assembly 300.

Various methods and techniques described above provide a number of ways to carryout the invention. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. An apparatus for removing bark from a log, the apparatus comprising:

a rotatable carriage having an opening sized to receive a log moving along a processing line passing through the opening; and a swing arm assembly comprising:

a mounting end rotatably coupled to the carriage such that the swing arm assembly is movable between an inner position and an outer position;

a working end configured to remove bark from the log as the carriage rotates;

a main body extending between the mounting end and the working end, an insert receiving portion positioned on the main body; and an insert disposed in the insert receiving portion and removably coupled to the main body, at least one fastener urging the insert against the insert receiving portion, the insert configured to cause the swing arm assembly to move from the inner position towards the outer position when the insert engages an end face of the log moving along the processing line towards the insert while the carriage rotates.

2. The apparatus of claim 1, wherein the insert and the insert receiving portion are nested to fixedly secure the insert to the insert receiving portion.

3. The apparatus of claim 1, wherein the insert has at least one fastener area that registers with a corresponding fastener area of the insert receiving portion.

4. The apparatus of claim 1, wherein the swing arm assembly is configured such that, while the working end debarks the log, the insert is spaced from the log.

5. The apparatus of claim 1, wherein the insert has a curved engagement edge for physically contacting and sliding along the log.

6. An apparatus for removing bark from a log, the apparatus comprising:

a rotatable carriage having an opening sized to receive a log moving along a processing line passing through the opening; and a swing arm assembly comprising:

a mounting end rotatably coupled to the carriage such that the swing arm assembly is movable between an inner position and an outer position;

a working end configured to remove bark from the log as the carriage rotates;

a main body extending between the mounting end and the working end; and an insert removably coupled to the main body with one or more adjustable fasteners, the insert configured to cause the swing arm assembly to move from the inner position towards the outer position when the insert engages an end face of the log moving along the processing line towards the insert while the carriage rotates.

7. The apparatus of claim 6, wherein each of the fasteners comprises an externally threaded member and an internally threaded nut, each threaded member extending through the insert and the main body and engaging a respective one of the threaded nuts.

8. An apparatus for removing bark from a log, the apparatus comprising:

a rotatable carriage having an opening sized to receive a log moving along a processing line passing through the opening; and a swing arm assembly comprising:

a mounting end rotatably coupled to the carriage such that the swing arm assembly is movable between an inner position and an outer position;

a working end including a removable debarking tool configured to remove bark from the log as the carriage rotates;

a main body extending between the mounting end and the working end, the main body including an insert receiving recess positioned between the removable debarking tool and the mounting end, and the insert occupies the insert receiving recess; and an insert removably coupled to the main body, the insert abutting a sidewall of the insert receiving recess and protruding outwardly from the insert receiving recess and the main body to define a leading edge spaced from the main body to cause the swing arm assembly to move from the inner position towards the outer position when the insert engages an end face of the log moving along the processing line towards the insert while the carriage rotates.

9. A swing arm assembly for removing material from a log, the assembly comprising:

a mounting end for rotatably coupling the swing arm assembly to a debarker;

a debarker tool end for receiving a tool adapted for removing bark from the log;

a main body extending between the mounting end and the debarker tool end, the main body having a receiving portion, the receiving portion comprising a recess; and an insert removably coupled to the receiving portion, the insert extending longitudinally along at least a portion of the main body from a location proximate the debarker tool and extending away from a sidewall of the recess outwardly past the main body to form a leading edge for contacting logs.

10. The swing arm assembly of claim 9, wherein the insert is nested in the receiving portion.

11. The swing arm assembly of claim 9, wherein the insert comprises mostly a first material, and the main body comprises mostly a second material which is different than the first material.

12. A swing arm assembly for removing material from a log, the assembly comprising:

a mounting end for rotatably coupling the swing arm assembly to a debarker;

a debarker tool end for receiving a tool adapted for removing bark from the log;

a main body extending between the mounting end and the debarker tool end, the main body having a receiving portion; and an insert removably coupled to the receiving portion, the insert extending longitudinally along at least a portion of the main body from a location proximate the debarker tool, the insert having a plurality of discrete fastening features positioned to engage a plurality of discrete mounting features on the receiving portion.

13. An insert for coupling to a swing arm assembly of a debarker, the swing arm assembly having a receiving section, the insert comprising:

a main body dimensioned to be closely received in the receiving section of the swing arm assembly;

an edge portion connected to the main body, the edge portion extending along a generally curved path, the edge portion configured to physically engage a log so as to facilitate movement of the swing arm assembly from a first, closed position to a second, open position when the insert is installed on the swing arm assembly and the edge portion contacts an end face of the log during operation; and at least one fastener area positioned along the main body, the at least one fastener area comprising a plurality of bolt holes positioned along the main body, and the plurality of bolt holes are positioned to register with a plurality of corresponding bolt holes in the receiving section.

14. The insert of claim 13, wherein the curved path is a generally arcuate path.

15. A method for replacing an insert on a debarker swing arm assembly having a receiving portion, the debarker swing arm assembly being coupleable to a debarker apparatus, the method comprising:

disengaging one or more fasteners from the insert;

separating the insert from the receiving portion of the debarker swing arm assembly;

positioning a different insert in the receiving portion of the debarker swing arm assembly, the receiving portion positioned between a debarker tool and a mounting end of the debarker swing arm assembly, the debarker tool configured to remove bark, the mounting end rotatably coupleable to the debarker apparatus; and removably coupling the insert to the receiving portion with the one or more fasteners.

16. The method of claim 15, further comprising:

removing the insert from the receiving portion; and coupling a second insert to the receiving portion with the one or more fasteners.

17. The method of claim 15, wherein the insert is configured to cause the debarker swing arm assembly to move from a first position outwardly towards the second position when the insert engages an end face of the log moving along a processing line towards the insert.

* * * * *